United States Patent [19]

Horky

[11] 4,038,736

[45] Aug. 2, 1977

[54] METHOD OF MANUFACTURING JEWELRY COMPONENTS

[76] Inventor: Reginald P. Horky, 1729 Arizona Ave., Flint, Mich. 48506

[21] Appl. No.: 690,663

[22] Filed: May 27, 1976

[51] Int. Cl.[2] ..... B23P 13/00

[52] U.S. Cl. ..... 29/160.6; 29/527.1; 29/527.6; 29/DIG. 30; 65/66

[58] Field of Search ..... 29/160.6, 527.1, 527.5, 29/527.6, DIG. 5, DIG. 24, DIG. 30, DIG. 42; 164/124, 1, 47; 65/66, 54

[56] References Cited

U.S. PATENT DOCUMENTS

| | | | |
|---|---|---|---|
| 991,623 | 5/1911 | Kadow | 65/66 |
| 999,391 | 8/1911 | Mealy et al. | 29/160.6 |
| 2,937,477 | 5/1960 | Beranek | 65/66 X |
| 3,288,585 | 11/1966 | Clarke | 65/54 X |

FOREIGN PATENT DOCUMENTS

| | | | |
|---|---|---|---|
| 60,459 | 4/1944 | Netherlands | 65/66 |
| 459,201 | 9/1935 | United Kingdom | 65/54 |

*Primary Examiner*—Victor A. DiPalma
*Attorney, Agent, or Firm*—Gifford, Chandler, Sheridan & Sprinkle

[57] ABSTRACT

A method of manufacturing jewelry from a meltable working material is provided and comprises the first step of mounting the working material onto one end of an elongated pick. The working material is then heated until molten at which time a portion of the working material is contacted with a cool base so that the working material hardens and bonds with the base at the point of contact. The pick is drawn away from the base while simultaneously heating and maintaining the remaining working material on the pick in the molten state thereby forming an elongated part for a jewelry end product.

5 Claims, 6 Drawing Figures

METHOD OF MANUFACTURING JEWELRY COMPONENTS

BACKGROUND OF THE INVENTION

I. Field of the Invention

The present invention relates to a method for manufacturing jewelry and jewelry parts from a meltable material.

II. Description of the Prior Art

There have been several previously known methods for jewelry production. Casting is one such method and involves forming a wax model of the desired jewelry end product and connecting a wax sprue to the wax model. The wax model with the attached sprue is then submerged into a molding material, typically plaster, and the molding material is allowed to harden thus forming a mold for the casting operation. The mold is heated so that the wax model and sprue melt and are drained away. Molten metal, such as molten gold, is then poured into the sprue in the mold and hardens to form the jewelry end product. The mold is then destroyed which leaves the casting or jewelry end product.

The casting method for producing jewelry end products is undesirable in that it requires a separate wax model and mold for each and every jewelry end product. Moreover, the overall casting method is time consuming and expensive not only with respect to the material costs, but also in labor costs.

Another method for producing jewelry end products comprises stamping or rolling the jewelry end products from a quantity of working material. The machinery and heavy equipment necessary for the stamping and rolling operation, however, is so costly that such equipment is beyond the financial reach of most artisans.

Soldering also forms another previously known method of jewelry construction. Using this method, precast jewelry components are secured together with molten solder to form the jewelry end product. The soldering method, however, requires precast jewelry components so that the previously mentioned disadvantages of the casting method are incurred with the soldering method of constructing jewelry end products. Moreover, soldering itself is a time consuming operation.

SUMMARY OF THE PRESENT INVENTION

The present invention overcomes the disadvantages of the previously known jewelry construction methods by providing a method for manufacturing jewelry components and end products which is not only simple and inexpensive, but which also requires only inexpensive tools to perform.

In brief, a meltable working material, such as gold or silver, is first mounted onto one end of an elongated pick by melting the working material onto the pick.

The working material on the pick is then heated with a torch or other means until the working material is molten. At that time a portion of the working material is contacted with a cool base so that the working material hardens and bonds with the base at the point of contact. The pick is then slowly drawn away from the base in the desired direction or arc while simultaneously heating and maintaining the remaining working material on the pick in a molten state.

When the working material on the pick is finally exhausted, an elongated jewelry component or end product is produced from the working material. In addition, an already constructed jewelry component may be used as the base for a subsequent jewelry component in order to form a jewelry end product.

The method of the present invention for jewelry construction is not only much simpler but also much less expensive and time consuming than the previously known methods of jewelry manufacture. Moreover, the method of the present invention may be performed with easily available and relatively inexpensive equipment.

BRIEF DESCRIPTION OF THE DRAWINGS

A better understanding of the present invention will be had upon reference to the following detailed description when read in conjunction with the accompanying drawing wherein like reference characters refer to like parts throughout the several views and in which.

DETAILED DESCRIPTION OF THE PRESENT INVENTION

Figure 1:
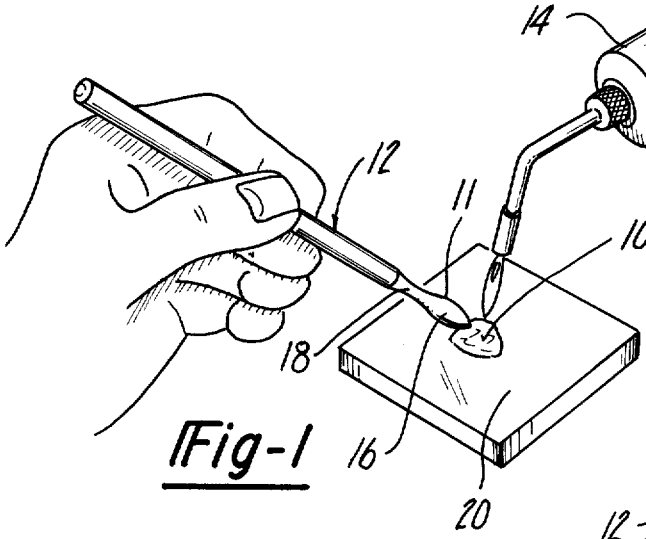
FIG. 1 is a perspective view showing the first step of mounting the working material onto a pick.

With reference to FIG. 1 a meltable working material 10, such as gold or silver, is first attached to one end 11 of an elongated pick 12. Although any conventional means may be used to initially mount the material onto the pick 12, preferably a torch 14 is used to melt the material 10 so that the molten material 10 may be collected onto the pick 12. In addition, the end of the pick 12 preferably includes an enlarged head portion 16 which tapers into a restricted neck portion 18. This construction retains the molten material 10 on the enlarged head portion 16 of the pick 12 and thus reduces wastage of the material 10.

Figure 2:
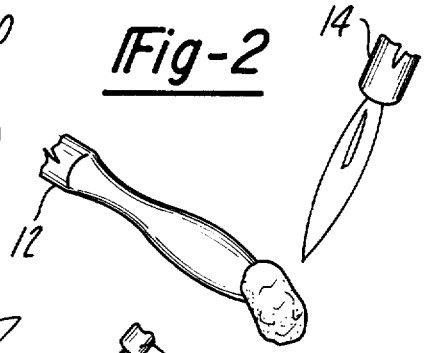
FIG. 2 is a perspective view showing the next step of heating the working material on the pick into a molten state.

With reference now to FIG. 2, with the material 10 mounted on the pick 12, the torch 14 is directed toward the material 10 to retain the material 10 in a molten state. The separation of the torch 14 from the material 10 determines the malleability of the molten metal. A soft wax consistency of the material 10 is required before proceeding to the next step for a reason to be later described.

Figure 3:
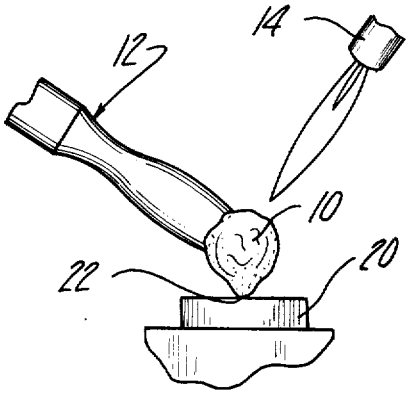
FIG. 3 is a perspective view showing the molten material on the pick contacting a cool base.

With reference to FIG. 3, a portion of the working material 10 is contacted at a point 22 with a cool base 20. At the point of contact 22 of the working material 10 with the base 20, the working material 10 hardens and bonds with the base 20.

Figure 4:
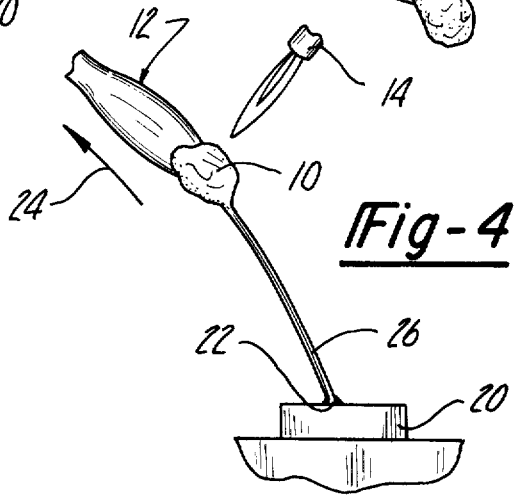
FIG. 4 is a perspective view showing the step of forming the jewelry component from the molten material.

With reference to FIG. 4, while continuing to heat the working material 10 remaining on the pick 12 with the torch 14, the pick 12 is drawn upwardly and away from the base 20 as shown by arrow 24. The working material 10 remains attached to the base 20 at the point 22 so that an elongated jewelry component 26 is formed between the pick 12 and the base 20. The previously mentioned soft wax consistency of the working material 10 on the pick 12 is required before drawing the pick 12 away from the base 20 in order to prevent separation or breakage of the working material 10.

When the working material 10 on the pick 12 is exhausted, or when a component 26 of sufficient length is obtained, the torch 14 is removed thus permitting the component 26 to harden. After the component 26 hardens, it may be easily removed from the base 20 by simply snapping and/or cutting the finding 26 from the base 20.

Figure 5:
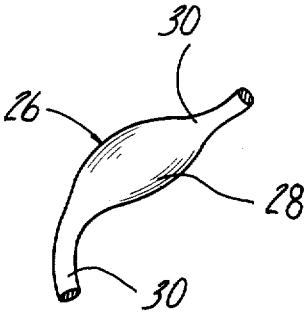
FIG. 5 is a perspective view showing an exemplary jewelry component constructed according to the method of the present invention.

The diameter of the head portion 16 of the pick 12 in combination with the point of contact 22 of the working material 10 with the base 20 and the rate of speed that the pick 12 is drawn away from the base 20 determines the thickness or diameter of the component 26. In practice, the diameter of the component 26 will be within twenty five percent (25%) of the diameter of the pick head portion 16. Moreover, as the pick 12 is drawn away from the base 20, the working material 10 hardens upwardly from the base 20 due to the separation of the torch 14 from that portion of the material 10 while the material 10 on the pick 12 remains in a molten state due to the torch 14. This sequential hardening of the material 10 permits the jewelry component 26 to be constructed in an arc shape as shown in FIG. 5. Also shown in FIG. 5, by varying the speed that the pick 12 is drawn away from the base 20, an increased diameter portion 28 and reduced diameter portions 30 are formed on the jewelry component 26.

Figure 6:
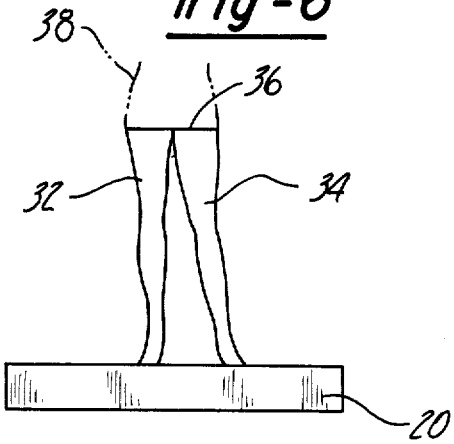
FIG. 6 is a plan view showing a jewelry end product using the method of the present invention.

An exemplary jewelry construction is shown in FIG. 6 in which two jewelry components 32 and 34 on the base 20 form the legs of a human figurine, the desired jewelry end product. By using the tops 36 of the legs 32 and 34 as the new base for a subsequent jewelry component, a torso 38 (shown in phantom line) of the figure can be drawn from the legs utilizing the method of the present invention. The arms and head of the figurine similarly use the torso 38 as the new base.

It can thus be seen that the method of the present invention provides a means for simply, rapidly, and inexpensively manufacturing jewelry components and end products.

Moreover, the method of the present invention may also be used to repair existing jewelry end products in the obvious fashion.

Having thus described my invention many modifications thereto will become apparent to those skilled in the art to which it pertains without deviating from the spirit of the invention as defined by the scope of the appended claims.

I claim:

1. A method of manufacturing elongated jewelry components having a solid cross section from metal comprising the steps of:
   - mounting a portion of the metal on a pick,
   - heating said metal portion on said pick until said metal portion is molten,
   - contacting a portion of said metal portion to a cool base whereby said metal portion hardens and bonds with said base at the point of contact, and
   - moving said pick away from said base while simultaneously heating and maintaining the metal portion remaining on said pick in a molten state.

2. The method as defined in claim 1 wherein said mounting step further comprises
   - melting said metal, and
   - collecting said portion of said metal on one end of said pick.

3. The method as defined in claim 2 wherein said end of said pick included an enlarged head portion which tapers into a reduced neck portion.

4. The method as defined in claim 1 and including the step of utilizing a previously constructed jewelry component as the cool base.

5. The method as defined in claim 1 wherein said step further comprises heating said metal portion until it obtains a soft wax consistency.

* * * * *